US009534470B2

(12) United States Patent
Aakre et al.

(10) Patent No.: US 9,534,470 B2
(45) Date of Patent: Jan. 3, 2017

(54) AUTONOMOUS VALVE

(75) Inventors: Haavard Aakre, Skien (NO); Vidar Mathiesen, Porsgrunn (NO); Bjørnar Werswick, Langesund (NO)

(73) Assignee: STATOIL PETROLEUM AS, Stavanger (NO)

( * ) Notice: Subject to any disclaimer, the term of this patent is extended or adjusted under 35 U.S.C. 154(b) by 567 days.

(21) Appl. No.: 13/979,351

(22) PCT Filed: Sep. 29, 2011

(86) PCT No.: PCT/EP2011/067058

§ 371 (c)(1),
(2), (4) Date: Sep. 30, 2013

(87) PCT Pub. No.: WO2012/095196

PCT Pub. Date: Jul. 19, 2012

(65) Prior Publication Data

US 2014/0027126 A1 Jan. 30, 2014

(30) Foreign Application Priority Data

Jan. 14, 2011 (WO) ..... PCT/EP2011/050471

(51) Int. Cl.
*E21B 34/08* (2006.01)
*E21B 43/12* (2006.01)

(52) U.S. Cl.
CPC ..... *E21B 34/08* (2013.01); *E21B 43/12* (2013.01)

(58) Field of Classification Search
CPC ..... E21B 34/08; E21B 43/12
See application file for complete search history.

(56) References Cited

U.S. PATENT DOCUMENTS 4,577,691 A 3/1986 Huang et al.
4,821,801 A 4/1989 Van Laar
(Continued)

FOREIGN PATENT DOCUMENTS

GB 2169018 A 7/1986
WO WO 91/03781 A1 3/1991
(Continued)

OTHER PUBLICATIONS

Mathiesen et al., "Autonomous Valve—New Technology for Inflow Control in Horizontal Wells", Society of Petroleum Engineers, Offshore Europe Oil and Gas Conference and Exhibition, 2011, (Abstract).

(Continued)

*Primary Examiner* — William P Neuder
(74) *Attorney, Agent, or Firm* — Birch, Stewart, Kolasch & Birch, LLP

(57) ABSTRACT

The invention relates to a method and apparatus for of controlling the flow of a fluid. The fluid comprises a liquid phase and a dissolved gas phase. The fluid passes through a valve, the valve comprising a fluid inlet and a movable body located in a flow path through the valve, the movable body being arranged to move freely relative to the opening of the inlet to vary the flow-through area through which the fluid flows by means of the Bernoulli effect. The dimensions of the valve are such that flow of the fluid past the movable body causes a drop in pressure to below the bubble point of the gas phase in the liquid phase, thereby increasing flow of the fluid through the valve.

17 Claims, 7 Drawing Sheets

(56) References Cited

U.S. PATENT DOCUMENTS

| | | | | |
|---|---|---|---|---|
| 4,858,691 | A | 8/1989 | Ilfrey et al. | |
| 6,371,210 | B1 | 4/2002 | Bode et al. | |
| 2003/0094283 | A1 | 5/2003 | Ivannikov et al. | |
| 2006/0027377 | A1 | 2/2006 | Schoonderbeek et al. | |
| 2009/0114393 | A1 | 5/2009 | Sharma et al. | |
| 2010/0282476 | A1 | 11/2010 | Tessier et al. | |
| 2011/0290326 | A1* | 12/2011 | Ovland | E21B 34/08 137/1 |
| 2013/0056221 | A1* | 3/2013 | Johannessen | E21B 33/1208 166/373 |

FOREIGN PATENT DOCUMENTS

| | | | |
|---|---|---|---|
| WO | WO 92/08875 | A2 | 5/1992 |
| WO | WO 98/20231 | A1 | 5/1998 |
| WO | WO 2008/004875 | A1 | 1/2008 |
| WO | WO 2009/088292 | A1 | 7/2009 |
| WO | WO 2009/088293 | A1 | 7/2009 |
| WO | WO 2009/136796 | A1 | 11/2009 |
| WO | WO 2010/053378 | A2 | 5/2010 |

OTHER PUBLICATIONS

White et al., "Controlling Flow in Horizontal Wells," World Oil, Nov. 1991, pp. 73-80.

* cited by examiner

AUTONOMOUS VALVE

TECHNICAL FIELD

The present invention relates to an autonomous valve arrangement for controlling a fluid flow.

BACKGROUND ART

Devices for recovering of oil and gas from long, horizontal and vertical wells are known from U.S. Pat. Nos. 4,821,801, 4,858,691, 4,577,691 and GB patent publication No. 2169018. These known devices comprise a perforated drainage pipe with, for example, a filter for control of sand around the pipe. A considerable disadvantage with the known devices for oil/and or gas production in highly permeable geological formations is that the pressure in the drainage pipe increases exponentially in the upstream direction as a result of the flow friction in the pipe. Because the differential pressure between the reservoir and the drainage pipe will decrease upstream as a result, the quantity of oil and/or gas flowing from the reservoir into the drainage pipe will decrease correspondingly. The total oil and/or gas produced by this means will therefore be low. With thin oil zones and highly permeable geological formations, there is also a high risk of coning, i.e. flow of unwanted water or gas into the drainage pipe downstream, where the velocity of the oil flow from the reservoir to the pipe is the greatest.

From World Oil, vol. 212, N. 11 (11/91), pages 73-80, it is known to divide a drainage pipe into sections with one or more inflow restriction devices such as sliding sleeves or throttling devices. However, this reference mainly deals with the use of inflow control to limit the inflow rate for up hole zones and thereby avoid or reduce coning of water and or gas.

WO-A-9208875 describes a horizontal production pipe comprising a plurality of production sections connected by mixing chambers having a larger internal diameter than the production sections. The production sections comprise an external slotted liner which can be considered as performing a filtering action. However, the sequence of sections of different diameter creates flow turbulence and prevents the running of work-over tools operated along the outer surface of the production pipe.

When extracting oil and or gas from geological production formations, fluids of different qualities, i.e. oil, gas, water (and sand) is produced in different amounts and mixtures depending on the property or quality of the formation. None of the above-mentioned known devices are able to distinguish between and control the inflow of oil, gas or water on the basis of their relative composition and/or quality.

Devices as disclosed in WO2009/088292 and WO 2008/004875 are robust, can withstand large forces and high temperatures, can prevent draw downs (differential pressure), need no energy supply, can withstand sand production, yet are reliable, simple and very cheap. However, several improvements might nevertheless be made to increase the performance and longevity of the above device in which many of the different embodiments of WO2009/088292 and WO 2008/004875 describe a disc or plate as a movable body of the valve.

One potential problem with a disc or plate as the movable body is erosion on the movable body. This is due to a very large fluid velocity between an inner seat and the movable body of the valve. The fluid is subjected to abrupt changes in its flow direction at this location. As there will always be particles in the fluid flow, even if sand screens are installed, such particles will cause erosion. The erosion problem exists both with and without the use of a stagnation chamber in the valve.

SUMMARY OF THE INVENTION

The above problems are solved by an autonomous valve arrangement provided with a flow control device according to the appended claims. The present invention relates to an inflow control device which is self adjustable, or autonomous, and can easily be fitted in the wall of a production pipe. The device also allows the use of work-over tools as it does not extend outside the outer periphery of the production pipe. The device is designed to "distinguish" between the oil and/or gas and/or water and is able to control the flow or inflow of oil or gas, depending on the fluid for which such flow control is required.

According to a preferred embodiment, the invention relates to a self-adjustable, or autonomous, valve or flow control device for controlling the flow of a fluid from one space or area to another. The valve is particularly useful for controlling the flow of fluid from a reservoir and into a production pipe of a well in the oil and/or gas reservoir, between an inlet port on an inlet side to at least one outlet port on an outlet side of the flow control device. Such a production pipe can include a drainage pipe comprising at least two sections each including one or more inflow control devices.

A major portion of the outlet port is connected to the recess in a position located remote from the central aperture relative to a plane through the second surface. In this way, a flow from the outlet port towards the inlet port will act on the second surface of a valve body remote from the inlet port. Such a fluid flow will cause the valve body to be moved towards the central aperture of the inlet port to close the valve.

The dimensions of the valve are such that flow of the fluid past the movable body causes a drop in pressure. The fluid typically comprises a liquid with a dissolved gas. The dissolved gas has a "bubble point", a temperature or pressure at which the gas will begin to come out of solution from the liquid. It has been found that if the drop in pressure is sufficient for the bubble point of the gas to be reached, dissolved gas comes out of solution with the liquid. This in turn increases the flow rate through the valve.

In a first example, a valve as described above can have an outlet port comprising multiple apertures each connected to the recess at a location at or radially outside the outer peripheral surface of the valve body. In this example, the multiple apertures are each connected to the recess in the radial direction of the flow control device. The multiple apertures can each be connected to the recess so that each aperture faces the outer peripheral surface of the valve body. The apertures are preferably arranged to be distributed at equal distances from each other around the circumference of the valve body. The centre axis of each aperture is arranged in a plane located remote from the central aperture relative to a plane through the second surface. In this way, said centre axes extend radially into the recess towards the centre of the valve body and can be located in or out of the plane through the second surface. Consequently, a flow from the multiple apertures towards the inlet port will act on the second surface of the valve body remote from the inlet port, causing the valve body to move towards its closed position.

In a second example, a valve as described above can have an outlet port comprising multiple apertures each connected to the recess at a location at or radially outside the outer peripheral surface of the valve body as described above. In this example, the multiple apertures are each connected to the recess in the axial direction of the flow control device, parallel to the centre axis of the inlet aperture. The multiple apertures can each be connected to the recess so that each aperture faces at least a portion of an outer peripheral section of the second surface of the valve body. The apertures are preferably arranged to be distributed at equal angles from each other relative to the centre of the valve body at substantially the same distance from said centre. The multiple apertures are each connected to the recess on the opposite side of the valve body relative to the inlet port. The centre axis of each aperture is connected to the recess so that each coincides with or passes radially outside the outer peripheral surface of the valve body. Consequently, a flow from the multiple apertures towards the inlet port will act on the second surface of the valve body remote from the inlet port, causing the valve body to move towards its closed position.

A valve body as described in any of the above examples is supported by at least three projections extending axially into the recess to support the second surface of the valve body. The projections are provided to support the valve body when it in its non-activated rest position. The number of projections and the size of the surfaces contacting the second surface of the valve body are chosen to avoid or minimize sticking between the projections and the movable valve body when the movable valve body is actuated.

In a third example, a valve as described above can have an outlet port comprising an aperture connected to the recess on the opposite side of the valve body relative to the inlet port. This aperture has a cross-sectional area equal to or greater than the second surface of the valve body. In this case, the outlet port substantially comprises a single aperture. The flow area downstream of the valve body is only interrupted by the projections extending into the recess to support the valve body.

A valve body as described in the above, third example is supported by at least three projections extending radially into the recess to support the second surface of the valve body. The projections are provided to support the valve body when it in its non-activated rest position. The number of projections and the size of the surfaces contacting the second surface of the valve body are chosen to avoid or minimize sticking between the projections and the valve body when the valve body is actuated.

The valves as described can have a valve body comprising a circular disc having a predetermined thickness. In this case, both the first surface and the opposite second surface can be flat or substantially flat. Generally, the surface of the recess facing said first surface of the valve body has a surface substantially conforming to the shape of the valve body.

Alternatively, the valve body can have a first surface with a substantially conical shape with the apex facing the inlet port. The opposite second surface of the valve body can be flat or substantially flat. The first surface of the recess facing said first surface has a substantially conical shape conforming to the shape of the valve body.

A valve arrangement for a production pipe, as described above, will typically have an inlet port diameter of 2-12 mm. The diameter of the disc is typically selected 3-5 times greater than the inlet port diameter. The diameter of the recess in the assembled valve body is inherently larger in order to allow movement of the disc and to hold the disc in position. It is possible to provide means for maintaining the disc in a centred position, but typically the fluid flow past the disc will try to distribute the fluid evenly through all outlet ports and thereby centre the disc.

The total height of the valve arrangement is dependent on the wall thickness of the production pipe in which it is mounted. It is desirable that the valve does not extend outside the outer diameter of the production pipe, in order to allow work-over tools to be operated along the outer surface of the production pipe. At the same time, it is desirable that the valve does not extend further inside the inner diameter of the production pipe than necessary, as this can introduce a flow restriction and turbulence. Consequently, it is desirable to select the disc thickness as small as possible. The dimensions of the disc (thickness/diameter) and the material used are selected to maintain mechanical stability of the disc, so that is does not flex or deform when subjected to high pressure. Also, the disc must be sufficiently robust to withstand erosion and fatigue over time. Similarly, the height of the recess containing the disc within the assembled valve body is limited by the height of the assembled valve body. The distance between the disc and the upper surface of the recess, containing the inlet port, is preferably selected so that the total flow area at the periphery of the disc is at least equal to the total flow are of the outlet port or ports.

The number or positioning of the outlet ports around the assembled valve body is chosen so that the total flow area of the outlet port or ports is therefore selected equal to or greater than the flow area of the inlet port. However, due to other factors, such as valve robustness and various particles entering the valve from the well, the total flow area of the outlet port or ports is often made considerably greater than the inlet port area.

In a further aspect of the invention, there is provided a method of controlling the flow of a fluid that comprises a liquid phase and a dissolved gas phase. The fluid is allowed to pass through a valve. The valve comprises a fluid inlet and a movable body located in a flow path through the valve. The movable body is arranged to move freely relative to the opening of the inlet to vary the flow-through area through which the fluid flows by means of the Bernoulli effect. The dimensions of the valve are such that flow of the fluid past the movable body causes a drop in pressure to below the bubble point of the gas phase in the liquid phase, thereby increasing flow of the fluid through the valve.

BRIEF DESCRIPTION OF THE DRAWINGS

The invention will be described in detail with reference to the attached figures. It is to be understood that the drawings are designed solely for the purpose of illustration and are not intended as a definition of the limits of the invention, for which reference should be made to the appended claims. It should be further understood that the drawings are not necessarily drawn to scale and that, unless otherwise indicated, they are merely intended to schematically illustrate the structures and procedures described herein.

DETAILED DESCRIPTION

An oil reservoir typically comprises liquid oil and gas. While a pocket of gas may be located above the liquid oil in the reservoir, gas is typically also dissolved in the liquid oil. As the temperature increases, and/or the pressure reduces, evolved gas may start to come out of solution. The 'bubble point' occurs at a certain temperature and pressure, and is the point at which the first bubble of gas comes out of solution. As oil in a reservoir is typically saturated with gas, it is very close to the bubble point.

When oil passes from a reservoir into a production pipe, the valve is designed such that the reduction in pressure on the oil causes it to fall below its bubble point. The drop below the bubble point causes gas to evolve from the oil, thereby increasing the liquid density and effectively increasing the flow rate of the liquid.

Figure 1:
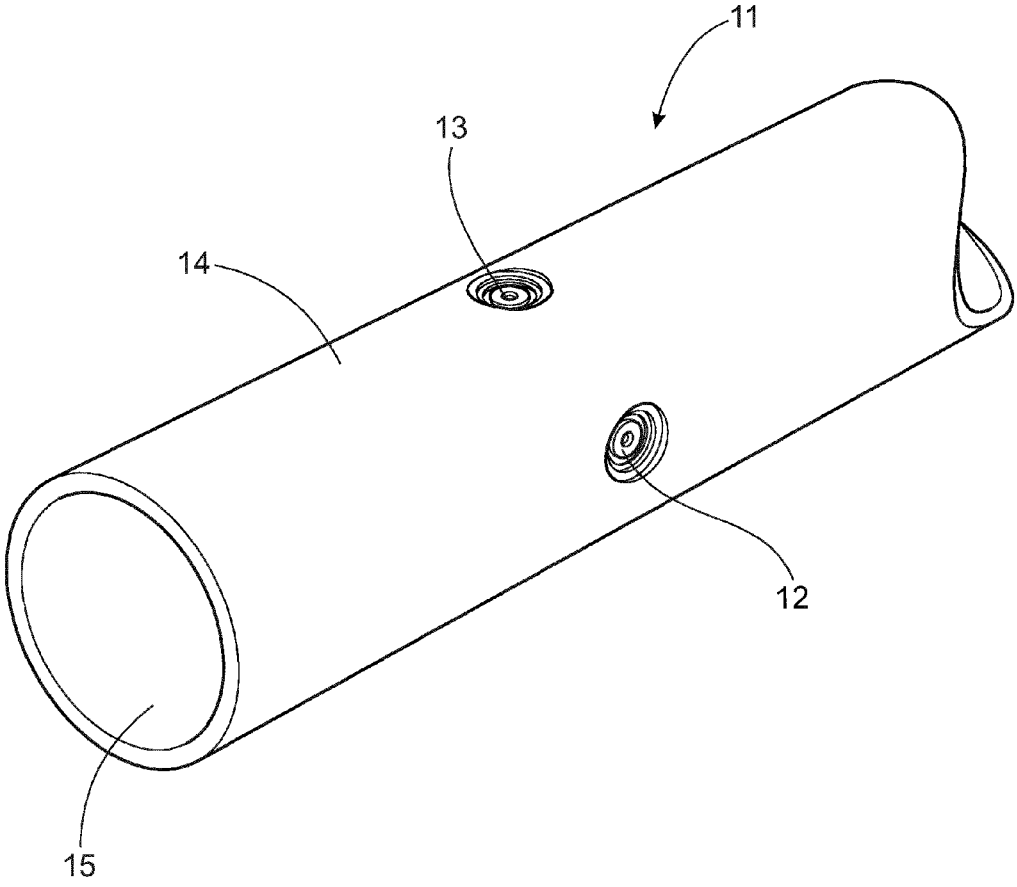
FIG. 1 shows a production pipe provided with an autonomous valve arrangement according to the invention.

FIG. 1 shows a production pipe 11 provided with an opening in which an autonomous valve arrangement 12 according to the invention. The valve arrangement 12 is particularly useful for controlling the flow of fluid from a subterranean reservoir and into a production pipe 11 of a well in the oil and/or gas reservoir, between an inlet port 13 on an inlet side to at least one outlet port (not shown) on an outlet side of the autonomous valve arrangement 12. The component part making up the entire autonomous valve arrangement is subsequently referred to as a "valve arrangement", while the active components required for controlling the flow are commonly referred to as a "flow control device". The inlet side of the autonomous valve arrangement 12 is located in the opening on the outer side 14 of the production pipe 11, while the outlet side is located on the inner side 15 of the production pipe 11. In the subsequent text, terms such as "inner" and "outer" are used for defining positions relative to the inner and outer surface of the valve arrangement when mounted in a pipe 11 (see FIG. 1).

Figure 2A:
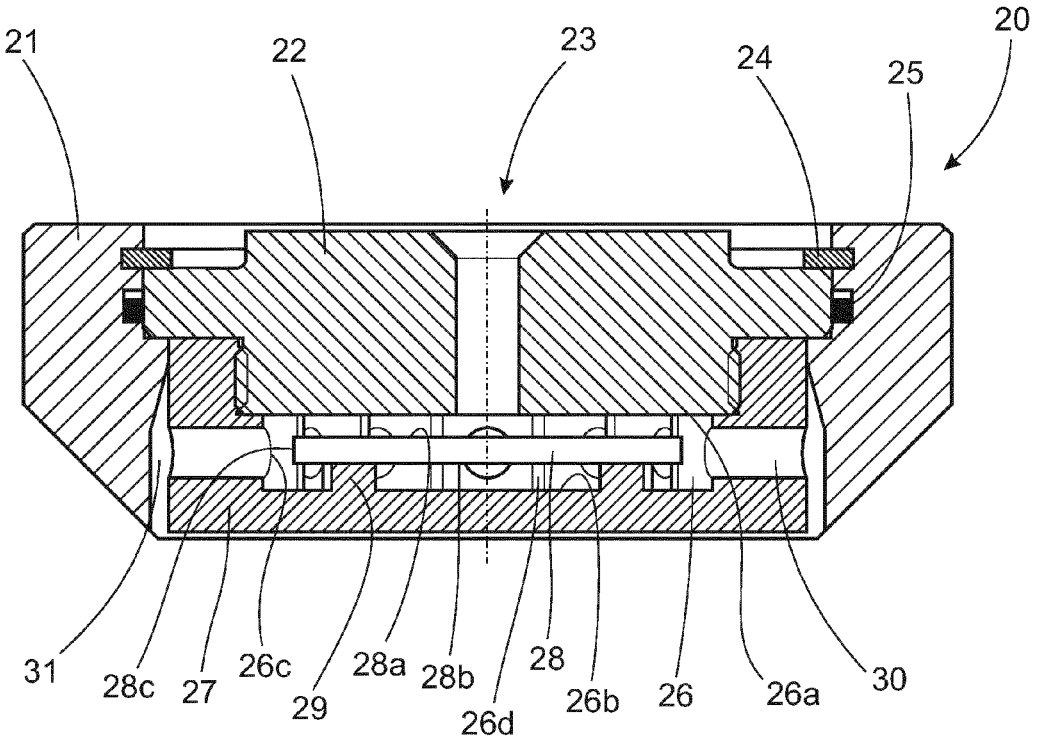
FIG. 2A shows an autonomous valve arrangement provided with a flow control device according to a first embodiment of the invention.

FIG. 2A shows an autonomous valve arrangement 20 provided with a flow control device according to a first embodiment of the invention. The valve arrangement 20 comprises an annular body 21 in which the flow control device is contained. The annular body 21 is mounted in an opening through a production pipe (see FIG. 1) by any suitable means, such as a force fit or a threaded connection. A first valve body 22 is located in a concentric enlarged bore in the annular body 21. An outer flange on the first valve body 22 is placed in contact with a radial surface of the bore in the annular body 21 in order to position the first valve body 22 in the axial direction of the annular body 21. The first valve body 22 is locked in place by means of a lock ring 24 acting on the opposite side of said outer flange and fixed in position in a circumferential groove in the inner surface of the bore in the annular body 21. A liquid seal is provided between the annular body 21 and the outer flange on the first valve body 22. The liquid seal comprises an O-ring located in a circumferential groove in the recess and in contact with the outer peripheral surface of the outer flange of the first valve body 22.

An axial inlet port 23 is provided through the centre of the first valve body 22. The inlet port 23 extends from an outer surface of the valve arrangement into a recess 26 in the flow control device. The recess 26 is formed in a space between the first valve body 22 and a second valve body 27. In the example shown in FIG. 2A, the second valve body 27 has a general cup-shape with an opening facing the first valve body 22. The second valve body 27 is placed in sealing contact with the first valve body 22 and is attached to the first valve body 22 by means of a threaded connection. The threaded connection is located on an inner section of the first valve body 22, below the outer flange. The second valve body 27 is provided with a number of radial outlet ports 30, extending from the recess 26 radially outwards to an annular space 31 between the annular body 21 and the second valve body 27. This annular space 31 is in fluid connection with the internal volume of the pipe in which the valve arrangement is mounted.

The second valve body 27 can be attached to the first valve body 22 by means of any suitable connecting means, but is preferably releasably attached by a threaded connection, screws or bayonet connection. A further alternative is to attach the second valve body 27 to the inner surface of the annular body 21, while maintaining sealing contact at least with the first valve body 22.

The valve arrangement further comprises a freely movable valve body 28 located in the recess 26 in the flow control device, said movable valve body 28 has a first surface 28*a* facing the inlet port 23 and a second surface 28*b* located remote from the inlet port 23. Similarly, the recess 26 has a first surface 26*a* facing the first surface 28*a* of the movable valve body 28, and a second surface 26*b* facing the second surface 28*b* of the movable valve body 28. The movable valve body 28 comprises a circular disc having a predetermined thickness and extending to an outer periphery 28*c* spaced from an adjacent side wall 26*c* of the recess 26. In this case, both the first surface and the opposite second surface are flat or substantially flat. For this and any other embodiment described in the text, the surface of the recess facing said first surface of the movable valve body has a surface conforming to the shape of the movable valve body. The movable valve body 28 is supported by a number of projections 29. The projections 29 define a lower position for the movable valve body 28 and prevent the said body 28 from sticking to the second surface 26*b* of the recess 26 during actuation of the flow control device. Hence, the components making up the flow control device is the first and second valve bodies 22, 27 and the freely movable valve body 28.

In operation, the inlet port is connected to the recess by a central aperture or opening, wherein the fluid is arranged to flow into the recess through the central aperture. The fluid is then arranged to flow out of the recess radially across a first surface of the valve body, said first surface facing the central aperture, and past the outer peripheral surface of said valve body towards at least one outlet port.

The present invention exploits the effect of Bernoulli teaching that the sum of static pressure, dynamic pressure and friction is constant along a flow line:

$$\Sigma p = p_{static} + \frac{1}{2}\rho v^2 + \Delta p_{friction} \tag{1}$$

With reference to the valve shown in FIG. 2A, when subjecting the movable valve body or disc 28 to a fluid flow, which is the case with the present invention, the pressure difference over the disc 28 can be expressed as follows:

$$\Delta p_{under} = [p_{under(f(p3))} - p_{over(f(p1,p2))}] = \frac{1}{2}\rho v^2 \quad (2)$$

Due to lower viscosity, a fluid such as gas will flow faster along the disc towards its outer periphery 28*c*. This results in a reduction of the pressure on the area A2 above the disc while the pressure acting on the area A3 below the disc 28 remains unaffected. As the disc 28 is freely movable within the recess it will move upwards and thereby narrow the flow path between the disc 26 and the first surface 26*a* of the recess 26. Thus, the disc 28 moves downwards or upwards depending on the viscosity of the fluid flowing through, whereby this principle can be used to control the flow of fluid through of the device.

Further, the pressure drop through a traditional inflow control device (ICD) with fixed geometry will be proportional to the dynamic pressure:

$$\Delta p = K\frac{1}{2}\rho v^2 \quad (3)$$

where the constant, K is mainly a function of the geometry and less dependent on the Reynolds number. In the control device according to the present invention the flow area will decrease when the differential pressure increases, such that the volume flow through the control device will not, or nearly not, increase when the pressure drop increases. Hence, the flowthrough volume for the present invention is substantially constant above a given differential pressure. This represents a major advantage with the present invention as it can be used to ensure a substantially constant volume flowing through each section for the entire horizontal well, which is not possible with fixed inflow control devices.

Furthermore, when a liquid with an entrained gas, such as oil from a reservoir, passes over the disc 28 the pressure reduces. The oil is already saturated with gas, and so approaching its bubble point. The reduction in pressure causes entrained gas to evolve from the oil, meaning the resulting oil slightly increases in density. This, along with pressure differences caused by the evolved gas, has the effect of pulling the disc 28 even further away from the inlet port 23, which increases the flow rate of oil through the autonomous valve arrangement 20.

Figure 6:
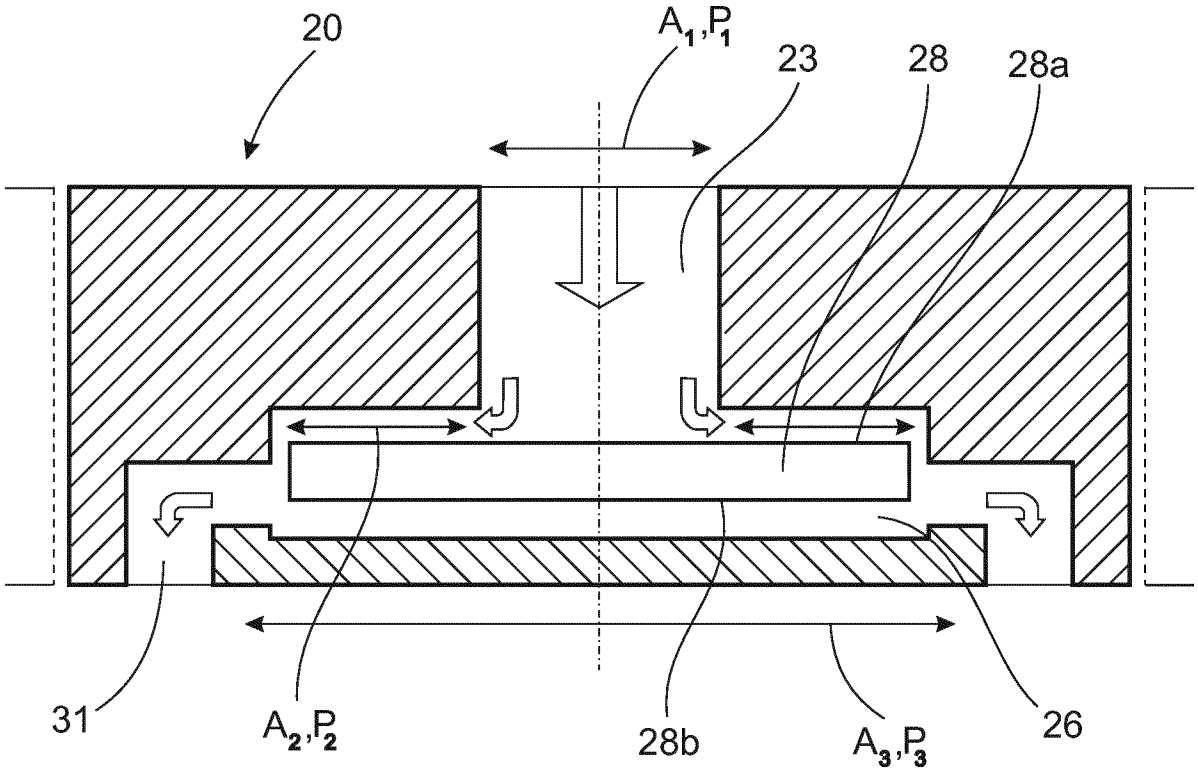
FIG. 6 shows a schematic diagram of the different flow areas and pressure zones in a valve according to the invention.

When producing oil and gas the flow control device according to the invention may have two different applications: Using it as inflow control device to reduce inflow of water or gas, or to maintain a constant flow through the flow control device. When designing the control device according to the invention for the different applications, such as constant fluid flow, the different areas and pressure zones, as shown in FIG. 6, will have impact on the efficiency and flow through properties of the device. Referring to FIG. 6, the different area/pressure zones may be divided into:

- A1, P1 is the inflow area and pressure respectively. The force (P1*A1) generated by this pressure will strive to open the control device (move the disc or body 28 downwards).
- A2, P2 is the area and pressure in the zone between the first surface 28*a* of the disc and the recess 26, where the velocity will be largest and hence represents a dynamic pressure source. The resulting dynamic pressure will strive to close the control device by moving the disc or body 28 upwards as the flow velocity increases and the pressure is reduced.
- A3, P3 is the area and pressure behind the movable disc or body 28, between the second surface 28*b* of the disc and the recess 26. The pressure behind the movable disc or body should be the same as the well pressure (inlet pressure). This will strive to move the body upwards, towards the closed position of the control device as the flow velocity increases.

Fluids with different viscosities will provide different forces in each zone depending on the design of these zones, in order to optimize the efficiency and flow through properties of the control device, the design of the areas will be different for different applications, e.g. constant volume flow, or gas/oil or oil/water flow. Hence, for each application the areas needs to be carefully balanced and optimally designed taking into account the properties and physical conditions (viscosity, temperature, pressure etc.) for each design situation.

Figure 2B:
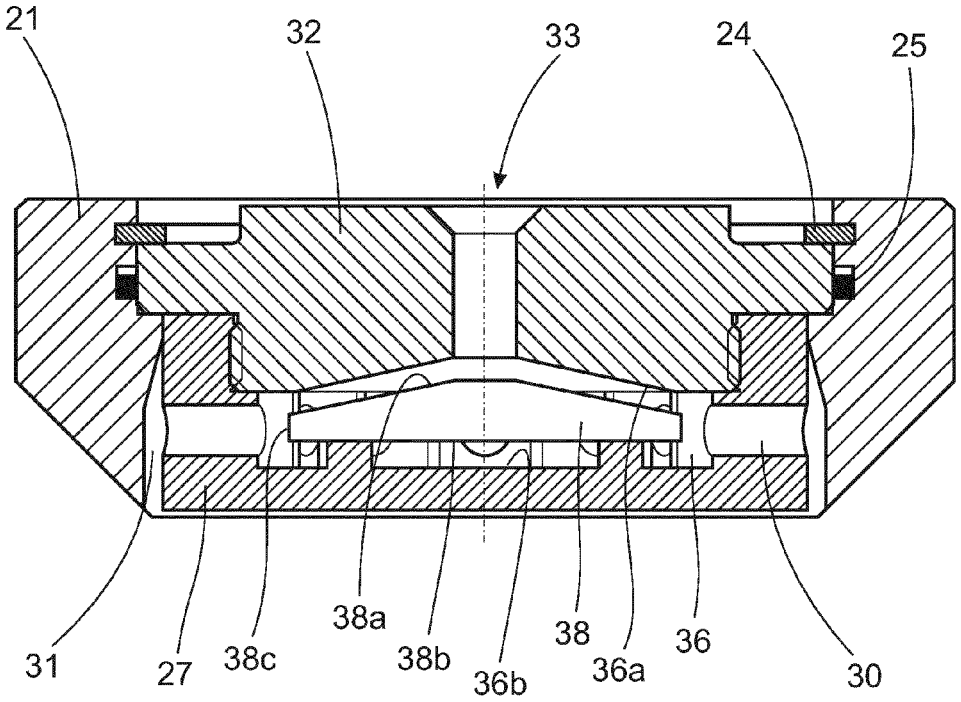
FIG. 2B shows an autonomous valve arrangement provided with a flow control device according to a second embodiment of the invention.

FIG. 2B shows an autonomous valve arrangement provided with a flow control device according to a second embodiment of the invention. The annular body 21 identical to that of FIG. 2A is mounted in an opening through a production pipe (see FIG. 1) by any suitable means, such as a force fit or a threaded connection. A first valve body 32 is located in a concentric enlarged bore in the annular body 21. The first valve body 32 is locked in place in the annular body 21 in the same way as described in connection with FIG. 2A above. An axial inlet port 33 is provided through the centre of the first valve body 32. A second valve body 27 substantially identical to that of FIG. 2A is attached to the first valve body 32, as described above. The second valve body 27 is provided with a number of radial outlet ports 30, extending from the recess 26 radially outwards to an annular space 31 between the annular body 21 and the second valve body 27.

The valve arrangement further comprises a freely movable valve body 38 located in the recess 36 in the flow control device, said movable valve body 38 has a first surface 38*a* facing the inlet port 33 and a second surface 38*b* located remote from the inlet port 33. Similarly, the recess 36 has a first surface 36*a* facing the first surface 38*a* of the movable valve body 38, and a second surface 36*b* facing the second surface 38*b* of the movable valve body 38. The movable valve body 38 comprises a first surface 38*a* with a substantially conical shape with the apex facing the inlet port 33. The opposite second surface 38*b* can be flat or substantially flat. The first surface 36*a* of the recess 36 facing said first surface 38*a* of the movable valve body 38 has a substantially conical shape conforming to the shape of the valve body. In the example shown, the movable valve body 38 comprises a conical body extending to an outer periphery 38*c* spaced from an adjacent side wall 36*c* of the recess 36. The outer periphery 38*c* can comprise a cylindrical surface having a predetermined height, as shown in FIG. 2B. Alternatively, the first and second surfaces 38*a*, 38*b* of the movable valve body 38 can merge directly at the outer periphery 38*c*.

Figure 3:
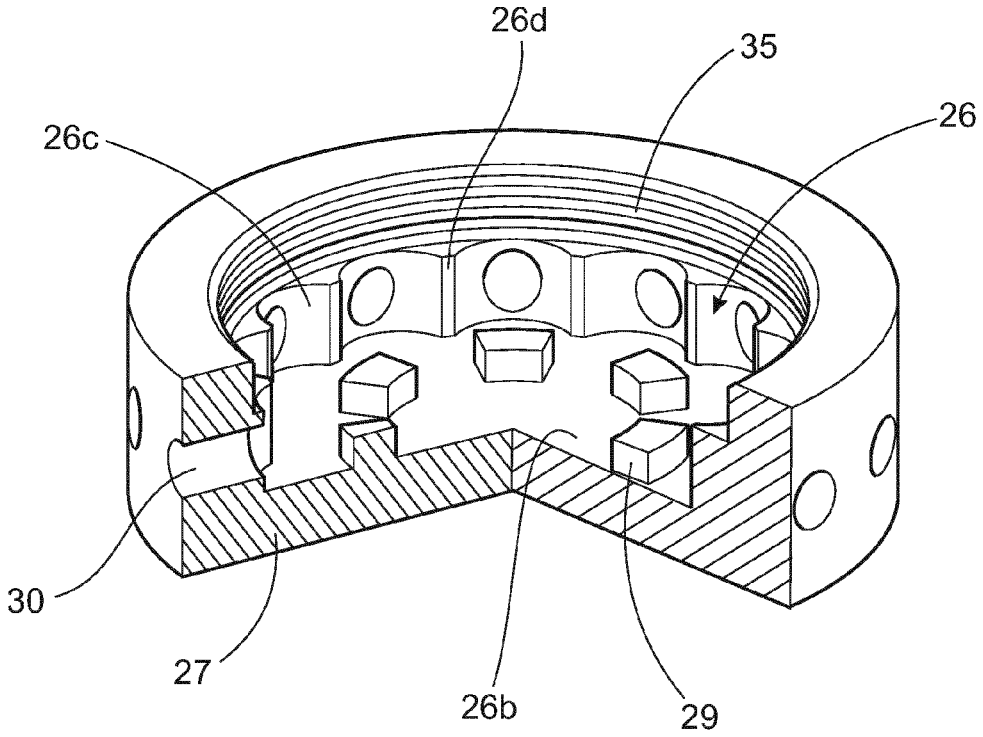
FIG. 3 shows a partially sectioned view of a second valve body as used in the embodiments of FIGS. 2A and 2B.

FIG. 3 shows a partially sectioned view of the second valve body 27 as used in the embodiments of FIGS. 2A and 2B. As described above, the second valve body 27 has a general cup-shape with an opening arranged to face a first valve body (see "22/32"; FIGS. 2A/2B). The second valve body 27 is placed in sealing contact with the first valve body and is attached to said first valve body by means of a threaded connection 35. The corresponding threaded connection on the first valve body is located on a cylindrical inner section of the first valve body. The second valve body 27 is provided with a number of radial outlet ports 30, extending radially outwards from the portion of the recess 26 delimited by the second valve body 27. The portion of the recess 26 delimited by said second valve body 27 comprises the second surface 26*b* and the side wall 26*c* of the recess 26. The side wall 26*c* of the recess 26 can comprise a part cylindrical cut-out coinciding with each radial outlet port 30, as shown in FIG. 3, but can also comprise a cylindrical surface having a constant diameter. The surfaces 26*d* located between adjoining cut-outs assist in maintaining the movable valve body in its centred position in the recess 26. However, in operation, the fluid flow past the movable valve body 28, 38 will normally cause the said valve body to be centred automatically.

FIG. 3 shows an embodiment provided with 12 outlet ports distributed at equal distances around the periphery of the second valve body 27. The outlet ports 30 are located radially outside the outer diameter of the movable valve body. The number and diameter of the outlet ports can be varied to fit the dimensions of the second valve body 27. The total flow area of the outlet ports must be at least equal to the flow area of the inlet port in the first valve body. The outlet ports 30 extend radially outwards through the annular wall of the second valve body 27, to reach an annular space between an annular body (see "21"; FIGS. 2A/2B) and the second valve body 27. This annular space is in fluid connection with the internal volume of the pipe in which the valve arrangement is mounted. The second surface 26*b* of the recess 26 is provided with 6 projections 29 arranged to support a movable valve body (see "29"; FIGS. 2A/2B). The number of projections 29 is preferably at least three and the width and radial extension of the respective upper surface of each projection determines the contact surface with the movable valve body. The number, surface area and radial location are selected to avoid or minimize sticking between the projections and the valve body when the movable valve body is actuated.

Figure 4:
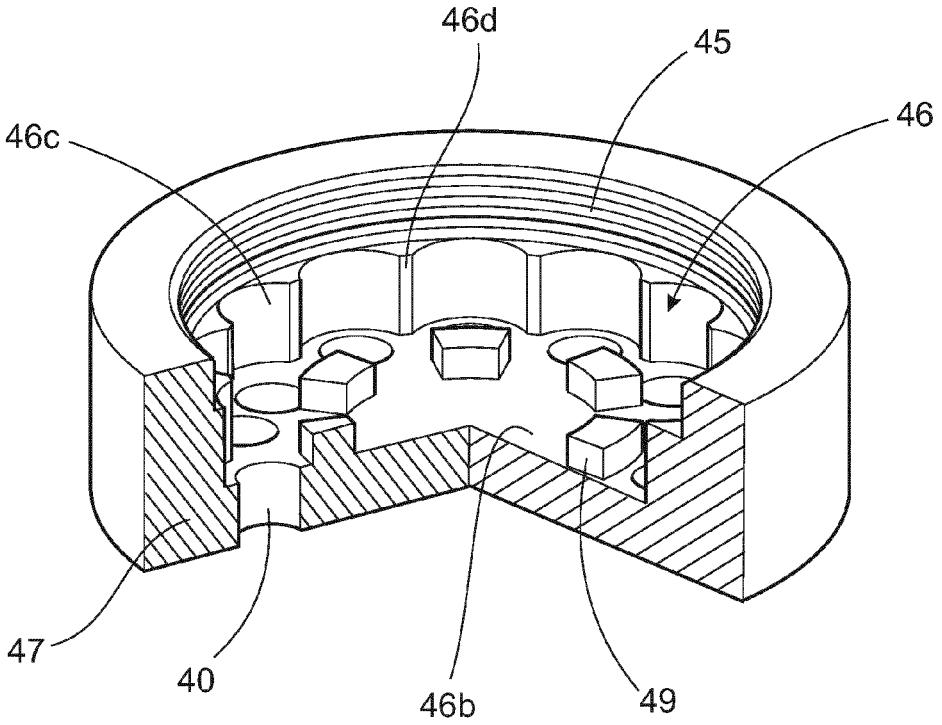
FIG. 4 shows a partially sectioned view of an alternative second valve body according to the invention.

FIG. 4 shows a partially sectioned view of an alternative second valve body according to the invention. The second valve body 47 as shown in FIG. 4 has a general cup-shape with an opening arranged to face a first valve body, in the same way as the second valve body in FIG. 3 (cf. "22/32"; FIGS. 2A/2B). The second valve body 47 is placed in sealing contact with the first valve body (not shown) to form a recess 46 and is attached to said first valve body by means of a threaded connection 45. The corresponding threaded connection on the first valve body is located on a cylindrical inner section of the first valve body.

The second valve body 47 differs from the second valve body 27 in FIG. 3 in that it is provided with a number of axial outlet ports 40, extending axially downwards from a lower, second surface 46*b* of the recess 46 delimited by the second valve body 47. As described in connection with FIG. 3, the portion of the recess 46 delimited by said second valve body 47 comprises a second surface 46*b* and a circumferential side wall 46*c* of the recess 46. The side wall 46*c* of the recess 46 can comprise a number of part cylindrical cutouts coinciding with each axial outlet port 40, as shown in FIG. 4, but can also comprise a cylindrical surface having a constant diameter. The surfaces 46*d* located between adjoining cut-outs assist in maintaining the movable valve body in its centred position in the recess 46.

FIG. 4 shows an embodiment provided with 12 outlet ports distributed at equal distances around the periphery of the second valve body 47. The central axes of the outlet ports 40 are located so that they intersect or pass radially outside the outer diameter of the movable valve body. The number and diameter of the outlet ports can be varied to fit the dimensions of the second valve body 47. The total flow area of the outlet ports must be at least equal to the flow area of the inlet port in the first valve body. The outlet ports 40 extend axially through the bottom of the cup-shaped second valve body 47, to reach the inner volume of the production pipe in which the valve arrangement is mounted. The second surface 46*b* of the recess 46 is provided with 6 projections 49 arranged to support a movable valve body (see "29"; FIGS. 2A/2B). The number of projections 49 is preferably at least three and the width and radial extension of the respective upper surface of each projection determines the contact surface with the movable valve body. The number, surface area and radial location are selected to avoid or minimize sticking between the projections and the valve body when the movable valve body is actuated.

Figure 5:
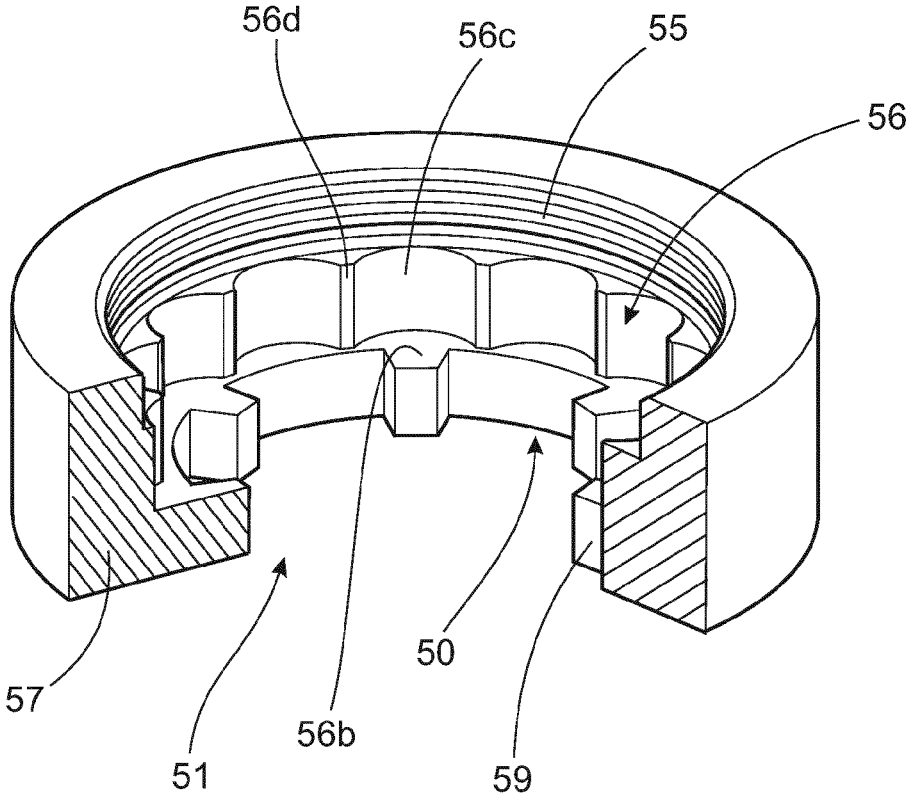
FIG. 5 shows a partially sectioned view of a further alternative second valve body according to the invention.

FIG. 5 shows a partially sectioned view of a further alternative second valve body according to the invention. The second valve body 57 as shown in FIG. 5 has a general cup-shape with a larger opening arranged to face a first valve body, as shown in FIG. 3 (cf. "22/32"; FIGS. 2A/2B), and a smaller central opening 51 facing the inner volume of the production pipe in which the valve arrangement is mounted. The second valve body 57 is placed in sealing contact with a first valve body (not shown) to form a recess 56 and is attached to said first valve body by means of a threaded connection 55. The corresponding threaded connection on the first valve body is located on a cylindrical inner section of the first valve body.

The second valve body 57 differs from the second valve body 47 in FIG. 4 in that it is provided with a central opening 51 having a number of radial recesses 50 forming a common outlet port 50, 51. The common outlet port 50, 51 extends axially downwards from a lower, second surface 56*b* of the recess 56 delimited by the second valve body 57. As described in connection with FIG. 4, the portion of the recess 56 delimited by said second valve body 57 comprises a second surface 56*b* and a circumferential side wall 56*c* of the recess 56. The side wall 56*c* of the recess 56 can comprise a number of part cylindrical cut-outs around the recess 56, as shown in FIG. 4, but can also comprise a cylindrical surface having a constant diameter. The surfaces 56*d* located between adjoining cut-outs assist in maintaining the movable valve body in its centred position in the recess 46.

FIG. 5 shows an embodiment where the combined outlet port 50, 51 is provided with 6 radial recesses 50 distributed at equal distances around the periphery of the central opening 51 of second valve body 57. The radial recesses 50 of the combined outlet port 50, 51 are located so that they extend radially outside the outer diameter of the movable valve body (not shown). The number and radius of the radial recesses 50 can be varied to fit the dimensions of the second valve body 57. The total flow area of the outlet port must be at least equal to the flow area of the inlet port in the first valve body. The combined outlet port 50, 51 extends axially through the bottom of the cup-shaped second valve body 57, to reach the inner volume of the production pipe in which the valve arrangement is mounted. The radial recesses 50 are separated by 6 projections 59 extending towards the centre of the central opening 51. The projections 59 are arranged to support a movable valve body (see "29"; FIGS. 2A/2B). The number of projections 59 is preferably at least three and the width and radial extension of the respective upper surface of each projection determines the contact surface with the movable valve body. The number, surface area and radial location are selected to avoid or minimize sticking between the projections and the movable valve body when the movable valve body is actuated.

It is, for instance, possible to combine either of the embodiments for the movable valve body as shown in FIGS. 2A or 2B with any one of the alternative second valve bodies of FIGS. 3-5. In addition, in case of a reverse flow from the outlet to the inlet through a valve arrangement according to the above embodiments, the outlet ports are positioned relative to the movable body so that a major portion of the fluid flow through the outlets into the respective recess will pass under the movable body and cause it to close.

The invention claimed is:

1. A self-adjustable (autonomous) valve or flow control device for controlling the flow of fluid from a reservoir and into a production pipe of a well in an oil and/or gas reservoir where the production pipe includes a drainage pipe comprising at least two sections including one or more inflow control devices, between an inlet port on an inlet side to at least one outlet port on an outlet side of the flow control device, the self-adjustable valve comprising:

a freely movable valve body arranged to move by exploiting the Bernoulli effect and located in a recess in the flow control device, said valve body having a first surface directly facing the inlet port and a second surface located remote from the inlet port;

the inlet port is connected to the recess by a central aperture (opening);

the valve is arranged to guide fluid to flow into the recess through the central aperture; and the valve is arranged to guide fluid to flow out of the recess radially across a first surface of the valve body, said first surface facing the central aperture, and past an outer peripheral surface of said valve body towards at least one outlet port, wherein the outlet port comprises multiple apertures connected to the recess and facing the outer peripheral surface of the valve body, the outlet port being arranged to guide fluid out of the recess radially, wherein the multiple apertures are at a location at or radially outside the outer peripheral surface of the valve body, and wherein the multiple apertures are each connected to the recess in the radial direction of the flow control device.

2. The self-adjustable valve according to claim 1, wherein a major portion of the outlet port is connected to the recess in a position located remote from the central aperture relative to a plane through the second surface.

3. The self-adjustable valve according to claim 1, wherein each aperture faces the outer peripheral (circumferential) surface of the valve body.

4. The self-adjustable valve according to claim 1, wherein the centre axis of each aperture is arranged in a plane located remote from the central aperture relative to a plane through the second surface.

5. The self-adjustable valve according to claim 1, wherein the valve body is supported by at least three projections extending into the recess towards the second surface of the valve body.

6. The self-adjustable valve according to claim 1, wherein the valve body comprises a circular disc.

7. The self-adjustable valve according to claim 1, wherein the valve body has a conical shape with the apex facing the inlet port.

8. A production pipe for use in a hydrocarbon reservoir, the production pipe comprising a drainage pipe, the drainage pipe comprising at least one valve according to claim 1, wherein the valve is arranged to control a flow of hydrocarbon fluids from the reservoir to an interior of the drainage pipe.

9. A valve for controlling the flow of a fluid into a production pipe of a well in a reservoir, wherein the reservoir is at least one of an oil reservoir and a gas reservoir, the fluid comprising a liquid phase and a dissolved gas phase, the valve comprising:

a fluid inlet;

a movable body located in a flow path from the fluid inlet through the valve, the movable body located in a recess of the valve, the movable body having a first surface directly facing the inlet port, the movable body being arranged to move freely relative to an opening of the inlet to vary the flow-through area through which the fluid flows by means of the Bernoulli effect; and an outlet port having multiple apertures connected to the recess and facing an outer peripheral surface of the movable body, the outlet port being arranged to guide fluid out of the recess radially, wherein the dimensions of the valve are such that flow of the fluid past the movable body causes a drop in pressure to below the bubble point of the gas phase in the liquid phase, thereby increasing flow of the fluid through the valve, wherein each aperture of the multiple apertures is connected to the recess at a location at or radially outside the outer peripheral surface of the movable body, and wherein each aperture is connected to the recess in the radial direction of the valve.

10. The valve according to claim 9, wherein the movable body has a second surface located remote from the inlet port;

wherein the inlet port is connected to the recess by a central aperture such that the fluid is arranged to flow into the recess through the central aperture; and the fluid is arranged to flow out of the recess radially across the first surface of the movable body, and past the outer peripheral surface of said movable body towards the outlet port.

11. The valve according to claim 10, wherein a major portion of the outlet port is connected to the recess in a position located remote from the central aperture relative to a plane through the second surface.

12. The valve according to claim 10, wherein the movable body is supported by at least three projections extending into the recess towards the second surface of the movable body.

13. The valve according to claim 9, wherein each aperture faces the outer peripheral (circumferential) surface of the movable body.

14. The valve according to claim 9, wherein the centre axis of each aperture is arranged in a plane located remote from the central aperture relative to a plane through the second surface.

15. The valve according to claim 9, wherein the movable body comprises one of a circular disc, and a conical shape with the apex facing the inlet port.

16. A production pipe for use in a hydrocarbon reservoir, the production pipe comprising a drainage pipe, the drainage pipe comprising at least one valve according to claim 9, wherein the valve is arranged to control a flow of hydrocarbon fluids from the reservoir to an interior of the drainage pipe.

17. A method of controlling the flow of a fluid into a production pipe of a well in a reservoir, wherein the reservoir is at least one of an oil reservoir and a gas reservoir, the fluid comprising a liquid phase and a dissolved gas phase, the method comprising allowing the fluid to pass through a valve, the valve comprising a fluid inlet, a movable body located in a flow path through the valve, the movable body located in a recess of the valve, the movable body having a first surface directly facing the inlet port, the movable body being arranged to move freely relative to the opening of the inlet to vary the flow-through area through which the fluid flows by means of the Bernoulli effect, and an outlet port having multiple apertures connected to the recess and facing an outer peripheral surface of the valve body, the outlet port being arranged to guide fluid out of the recess radially, wherein the dimensions of the valve are such that flow of the fluid past the movable body causes a drop in pressure to below the bubble point of the gas phase in the liquid phase, thereby increasing flow of the fluid through the valve, wherein the multiple apertures are at a location at or radially outside the outer peripheral surface of the valve body, and wherein the multiple apertures are each connected to the recess in the radial direction of the flow control device.

* * * * *